US006012721A

United States Patent [19]

Harnish

[11] Patent Number: 6,012,721

[45] Date of Patent: Jan. 11, 2000

[54] BASKETBALL CARD GAME

[76] Inventor: David J. Harnish, 1117 E. Emerald, Mesa, Ariz. 85204

[21] Appl. No.: 08/886,295

[22] Filed: Jul. 1, 1997

[51] Int. Cl.[7] ..... A63F 1/00

[52] U.S. Cl. ..... 273/298

[58] Field of Search ..... 273/298, 244, 273/244.1, 244.2

[56] References Cited

U.S. PATENT DOCUMENTS

| | | | |
|---|---|---|---|
| 1,547,313 | 7/1925 | Foster | 273/298 |
| 1,594,807 | 8/1926 | Wurth | 273/244 |
| 1,661,216 | 3/1928 | Destefano | 273/244 |
| 2,261,448 | 11/1941 | Petersen | 273/317.3 |
| 3,545,763 | 12/1970 | Seltz | 273/244 |
| 3,907,295 | 9/1975 | Eissler | 273/244 |
| 3,941,386 | 3/1976 | Nelson | 273/259 |
| 4,186,928 | 2/1980 | Hunt, Jr. | 273/244 |
| 4,634,125 | 1/1987 | Seklecki | 273/244.2 |
| 4,822,043 | 4/1989 | Carter | 273/298 |
| 4,856,780 | 8/1989 | Begley et al. | 273/244 |
| 5,123,653 | 6/1992 | Murphy et al. | 273/244 |
| 5,145,173 | 9/1992 | Crowder | 273/298 |
| 5,749,581 | 5/1998 | Poisson | 273/244 |

FOREIGN PATENT DOCUMENTS 2573666 5/1986 France .

*Primary Examiner*—Benjamin H. Layno

*Attorney, Agent, or Firm*—Martin & Associates, L.L.C.; Derek P. Martin

[57] ABSTRACT

The present invention includes an apparatus and method for executing a sports card game. In the preferred embodiment, the apparatus comprises a basketball card game with a plurality of basketball play action events distributed to two players as a hand of cards and dice for generating random numbers. Each card describes one event and dice are used to determine the success of field goal attempts and possession after the tip-off and loose balls. The recurrence of one event on multiple cards is similar to the regularity with which the event occurs in a real basketball game. Also, the probability of rolling a number that results in a score corresponds to the nominal field goal percentage for a typical, real game of professional basketball. Additionally, players may strategically select a card to enter into play similar to selecting predetermined plays in real basketball. Other embodiments of the invention include a similar game played with representations of play action events, possibly cards, displayed on an electronic screen and a random number generated by an electronic device. Other embodiments of the invention also include play action events selected from other sports wherein the method of playing the game falls within the method disclosed herein.

1 Claim, 5 Drawing Sheets

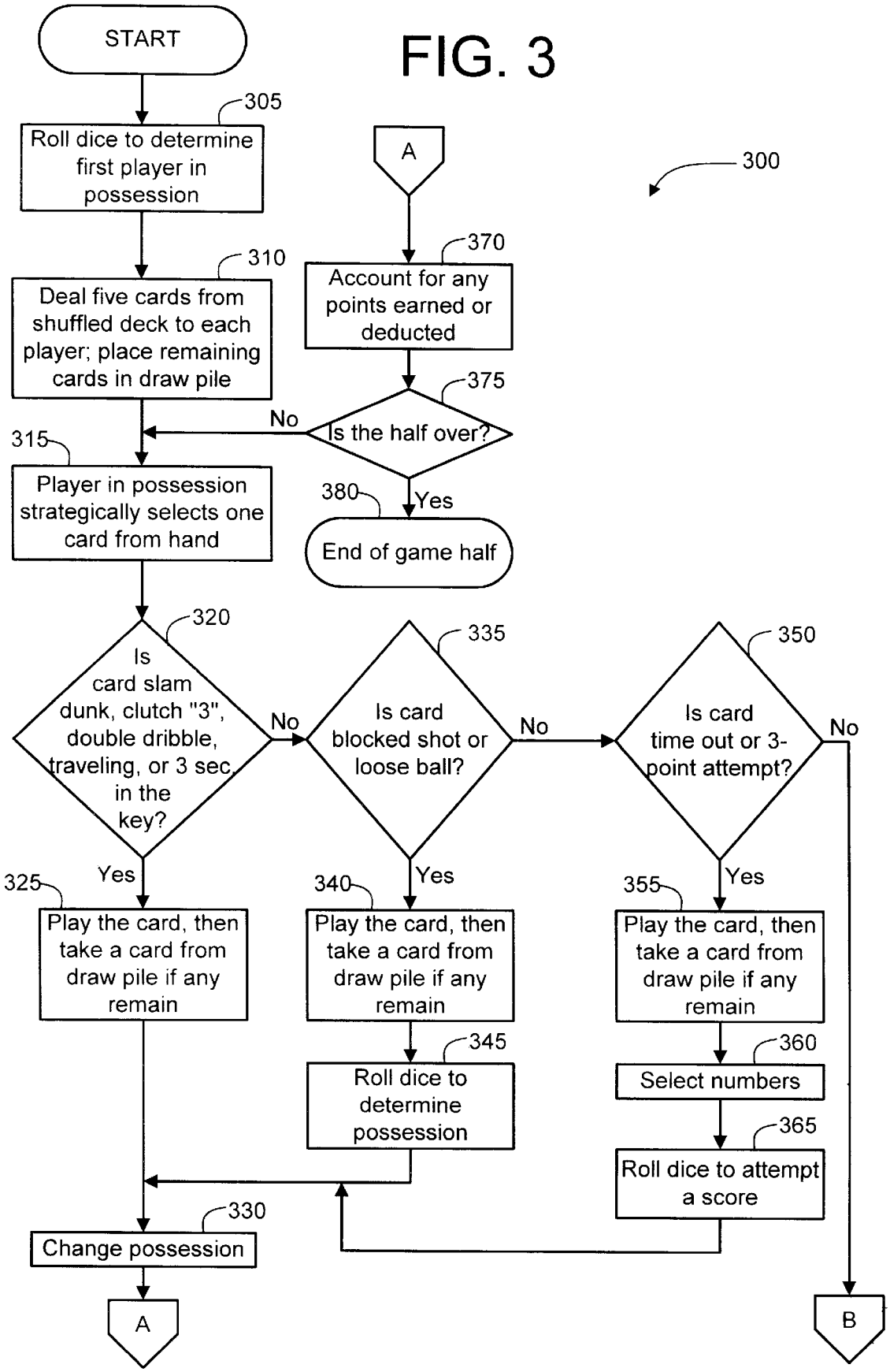
FIG. 3
START
305
Roll dice to determine first player in possession
310
Deal five cards from shuffled deck to each player; place remaining cards in draw pile
315
Player in possession strategically selects one card from hand
320
Is card slam dunk, clutch "3", double dribble, traveling, or 3 sec. in the key?
No
Yes
325
Play the card, then take a card from draw pile if any remain
330
Change possession
A
A
370
Account for any points earned or deducted
375
Is the half over?
No
Yes
380
End of game half
335
Is card blocked shot or loose ball?
No
Yes
340
Play the card, then take a card from draw pile if any remain
345
Roll dice to determine possession
350
Is card time out or 3-point attempt?
No
Yes
355
Play the card, then take a card from draw pile if any remain
360
Select numbers
365
Roll dice to attempt a score
B
300

BASKETBALL CARD GAME

BACKGROUND OF THE INVENTION

1. Field of the Invention

The invention relates to the field of sports games. More particularly, the invention is a basketball card game that uses dice and cards in combination to score and determine play action events.

2. Description of Related Art

There are a number of different types of games that represent various different sporting events, such as, basketball and baseball. Many known games commonly use game boards, playing pieces, spinner dials, dice, cards, and other devices for executing the game. U.S. Pat. No. 5,145,173 issued to Crowder and U.S. Pat. No. 4,822,043 issued to Carter each describe a baseball card game played without a game board. U.S. Pat. No. 5,123,653 issued to Murphy et al., U.S. Pat. No. 4,186,928 issued to Hunt, Jr., and U.S. Pat. No. 1,594,807 issued to Wurth each describe a basketball game played with a game board. In addition, Murphy et al. also uses cards. The prior art sports games can be typified by their complexity of play. The objective behind most of the prior art is to provide a game that simulates the flow of events in a real game of baseball or basketball. Accordingly, prior art games use a wide variety of methods to involve elements of both strategy and chance to achieve a realistic flow of events in the game. Playing a real game of baseball or basketball involves a tremendous number of variables dependent on both strategy and chance. Thus, the prior art games generally involve a complex arrangement of information that is manipulated by strategy, chance or both to yield a realistic flow of events in playing the game.

Many known prior art basketball games require a game board to be played. Generally, the game board has the appearance of a basketball court, but it serves a multitude of purposes in executing the game. In Murphy et al., the game board designates spaces marked around the periphery of the game board. After a roll of dice, a player moves a token around the periphery of the game board and, depending on which space they reach, answers a selected trivia question. The game board also has a miniature basketball goal mounted to the game board and, if the trivia question is answered correctly, then the player shoots a miniature basketball at the goal in an attempt to score. In Hunt, Jr., the game board incorporates a series of offensive and defensive position spaces where a player may locate offensive and defensive athlete tokens. Also, multiple spinner dials are mounted to the game board. Using the spinner dials, players control movements of a ball token between offensive and defensive athletes positioned on the game board with the ultimate goal of moving the ball token into the spot designated as the basketball goal. In Wurth, the game board also incorporates several spinner dials that dictate the outcome of play action. The spinner dials address such play action topics as shots, fouls, jump balls, delays in play, out of bounds ball and other play actions.

Since all known prior art basketball games use game boards, it can be implied from the art that a game board is necessary to yield a realistic flow of events. Unfortunately, the game boards are rather bulky and require tokens for playing the game that can easily become lost. To prevent such loss, the game boards and tokens are typically stored in a box that is similarly bulky. As indicated above, game boards are also known to include a basketball goal and playing the game includes tossing a miniature ball through the goal or snapping a chip from the board through the goal.

Tossing a miniature ball or snapping a chip can be a difficult task that interrupts the flow of events simulating a real game and only slightly resembles shooting a basket in a real game of basketball.

Similar to game boards, using a spinner dial to generate random events in a basketball game adds bulk to the game apparatus. Prior art games incorporate spinner dials directly into the game board, however, it would be within the general game art to use spinner dials separate from the game board. Even if a separate spinner dial were used, bulk is still added. The spinner dials used in the prior art dictate by an element of chance how the flow of events in a game will occur. To accomplish this objective, more than simply a few dials are incorporated into the game board, again adding to the bulk. Further, use of spinner dials overemphasizes the element of chance in playing the game. To accurately simulate the flow of a real basketball game, players in a game should possess at least some capability to strategically control the flow of events, similar to calling plays in a real game. Prior art games, particularly those with spinner dials, rely almost solely on the element of chance to control the flow of events. In a real game of basketball, the athletes have established shooting percentages, thus, it can be said that with each field goal attempted there is a specified chance of success. However, movement of the ball in a real game between athletes into a scoring position is largely a matter of skill and strategy. Accordingly, a game that leaves to chance the plays that are executed in a game is unlike a real game of basketball. Similarly, a game that incorporates an element of chance into a field goal attempt and a predominant element of strategy in the plays that are executed is more like a real game of basketball.

Another mechanism for incorporating an element of chance in a prior art game is a die. The prior art teaches use of a common six-sided die or a pair of such dice, but the function of the die or dice differs widely among the art. In one basketball game (Murphy et al.) using a game board, the result from roll of a die indicates how far a player will move a token through designated spaces marked around the periphery of the game board. Depending on which space they reach, the player answers a selected trivia question to gain the opportunity to shoot a miniature basketball at a miniature goal in an attempt to score. Thus, the dice are used to select a trivia question.

In a baseball card game (Crowder) without a game board, an imaginary pitcher plays against an imaginary batter. The pitcher is portrayed by a card bearing a matrix of batting results most favorable to the defensive player whom the pitcher represents. Similarly, the batter is portrayed by a card bearing a matrix of batting results most favorable to the offensive player whom the batter represents. The die is used to determine whether the pitcher card or the batter card will be used. An odd-numbered result of the die indicates the pitcher card, while an even-numbered result indicates the batter card. Thus, the dice are used simply to select what matrix will be used to establish a batting result.

Yet another baseball card game (Carter) without a game board also uses dice, but the dice are specially adapted to the game. Instead of numerals between one and six on the six sides of one die, the die indicates the letter P on three sides and the letter B on three sides. Similar to the game described above, rolling a P on the die indicates a pitcher card will be used, while rolling a B on the die indicates a batter card will be used. Two other dice are also used, the six sides of which are numbered one through six, but one die is marked as being the die to read first. The result on the die read first constitutes the first digit in a two-digit number and the result on the die read second constitutes the second digit in a two digit number. The two-digit number is then used to select a batting result from a numbered list of batting results on the pitcher or batter card. Accordingly, the dice are used both to select what list will be used to establish a batting result and to select a batting result from the list.

As seen from the description above regarding three prior art games using dice, the result shown on a die bears no independent significance in prior art sports games. Rather, the result shown on a die must be used in conjunction with some other game element such as a game board, list of questions, matrix of results or list of results. By linking the die result with some other element, the complexity of the game is increased, the die cannot determine a result by itself other than to tell a player how to manipulate another mechanism that will determine a play action event.

Another common mechanism in prior art games are cards. The prior art teaches use of cards sized similarly to common playing cards, but the function of the cards and the indicia written thereon differ widely among the art. In one basketball game (Murphy et al.) using a game board, a player answers a selected trivia question from a card to gain the opportunity to shoot a miniature basketball at a miniature goal in an attempt to score. The position of a token on designated spaces marked around the periphery of the game board dictates what question must be answered from the list of questions on a card. Thus, the cards are used to select a trivia question that may qualify a player to attempt to score. The strategy element in a game of this type is practically nonexistent, while the chance element is associated with selecting a trivia question to ask.

In one baseball card game (Crowder) without a game board, a player selects hypothetical team members from a group of athlete cards to which each is assigned performance criteria. The performance criteria are embodied in a matrix printed on each card, wherein the matrix reflects the increased likelihood of better skilled batters to successfully get on base, or the increased likelihood of better skilled pitchers to prevent a batter from getting on base. Either the pitcher or batter matrix is randomly selected using the result from roll of a die each time a new batter card is presented at bat, then a play action event is randomly selected from the matrix with the aid of standard playing cards. The standard playing cards act as a random number generator, wherein the number on a card taken from a draw pile of such cards dictates the row selected on the pitcher or batter matrix and the suit on a card dictates the column. Thus, the cards in a prior art game of this type are used to identify individual team members, provide performance criteria in a matrix, and generate a random character. The strategy element in playing a game of this type includes choosing athletes that perform the best and arranging the athletes in a playing order that is advantageous to winning the game. The chance element includes determining the play action events that occur in the game.

Yet another baseball card game (Carter) without a game board also uses cards with a function similar to the baseball card game described above. A player selects hypothetical team members from a group of athlete cards to which each is assigned performance criteria. The performance criteria are embodied in a list printed on each card that is substantially similar in function to the matrix described above. Also, either the pitcher or batter list is randomly selected using a die, then a generic play action event is randomly selected from the list with the aid of two other dice. The generic play action event is then compared to other reference cards to determine the specific result in the flow of events considering other factors such as the stadium or field in which the imaginary game is being played. Thus, the cards in a prior art game of this type are used to identify individual team members, provide performance criteria in a matrix, and provide additional reference data that dictates the outcome of play action events. As described above, the strategy element includes choosing and arranging the batting order of athletes while the chance element includes determining the play action events that occur in the game.

Thus, it can be seen from the above discussion that it would be an improvement in the art to provide a sports game played with compact apparatus that is simple to execute yet possesses a flow of events similar to real sports. Specifically, this means providing a simple, compact basketball card game wherein players strategically determine what play action events to enter as in real basketball and certain play action events are modified or dictated by an additional element of chance.

SUMMARY OF THE INVENTION

According to the present invention, an apparatus and method for executing a sports card game are disclosed. The game of the present invention includes play action events that a player may strategically select for entry into play and a random character generator for determining possession of a scoring opportunity and partially determining success of a scoring opportunity. One embodiment of the invention is a basketball card game including a plurality of basketball play action events distributed to two players as a hand of cards and dice for generating random numbers. Each card describes one event and the recurrence of one event on multiple cards is similar to the regularity with which the event occurs in a real basketball game. For example, four Slam Dunk Cards might be present among a total of sixty cards indicating that in real basketball about four plays out of every sixty result in a slam dunk. Cards not distributed to the players are stacked in a draw pile from which a player takes a new card to replace a card entered into play. Scoring is possible by playing a card that indicates a score or by rolling the dice. The probability of rolling a number that results in a score corresponds to the nominal field goal percentage for a typical, real game of professional basketball. Similarly, since three-point attempts in real basketball possess a lower percentage of success, if a player plays a Three-Point Attempt card the probability of a score is less. Other embodiments of the invention include a similar game played with representations of play action events, possibly cards, displayed on an electronic screen and a random number generated by an electronic device.

It is an advantage of the present invention that the game includes a compact, easy-to-use deck of cards or plurality of play action events and two dice or a random number generator.

It is a further advantage that the flow of events in the game resembles the flow of events in a real game of basketball.

It is a still further advantage that the game includes a significant element of strategy and a lesser element of chance as in real basketball.

The foregoing and other features and advantages of the present invention will be apparent from the following more particular description of preferred embodiments of the invention, as illustrated in the accompanying drawings.

BRIEF DESCRIPTION OF THE DRAWINGS

The preferred embodiments of the present invention will hereinafter be described in conjunction with the appended drawings, wherein like designations denote like elements, and:

FIG. 3 is a flow chart of part of the method for executing the game;

DESCRIPTION OF THE PREFERRED EMBODIMENTS

According to the present invention, an apparatus and method for playing a sports card game are disclosed. The apparatus and method are particularly conducive to a basketball card game, however, other embodiments are within the scope of the invention. The present invention involves a significant strategy element and flow of events resembling real sports games while providing a compact, easy-to-use apparatus and method. The preferred embodiment of such a sports game is described in FIGS. 1–4 and the explanation below.

Figure 1:
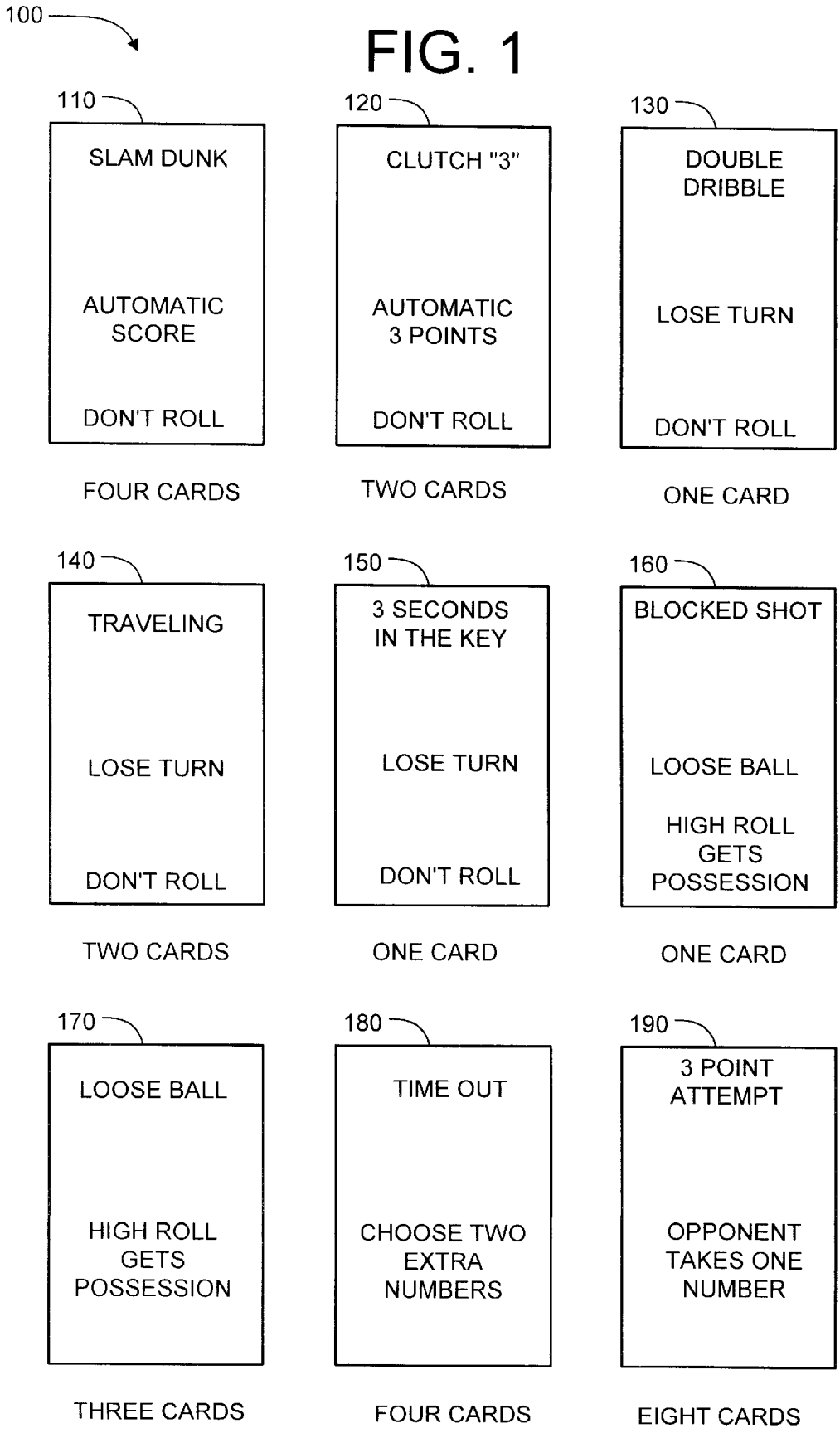
FIG. 1 is a display of cards that are played before the roll of dice.
Figure 2:
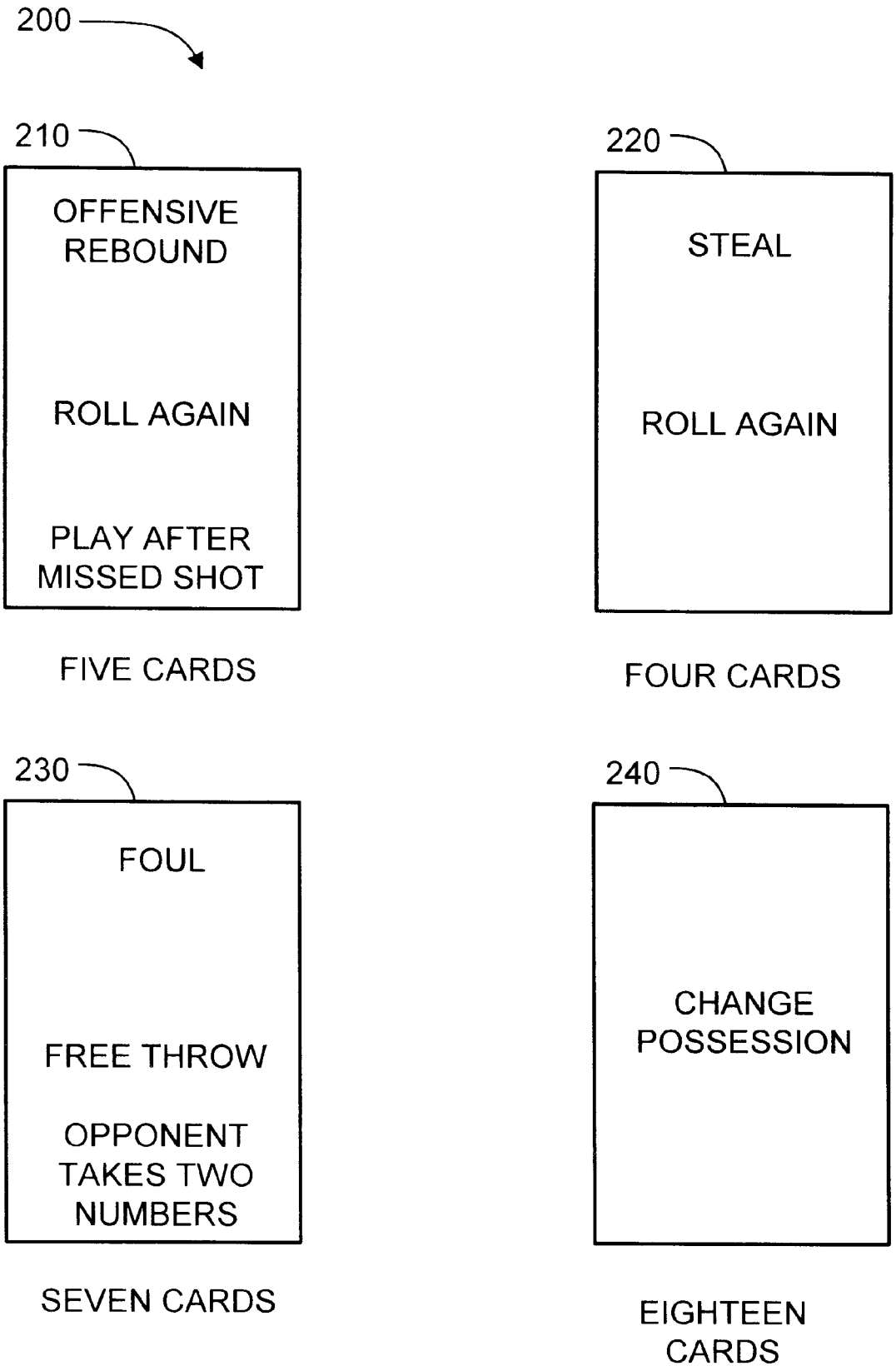
FIG. 2 is a display of cards that are played after the roll of dice.

One element of the apparatus is a mechanism for generating a random character that, in the preferred embodiment, comprises two common six-sided dice (not shown). Another element of the apparatus is a plurality of play action events distributed as a hand to players that, in the preferred embodiment, comprises sixty cards each describing one of thirteen possible play action events that correspond to events from a real basketball game (see FIGS. 1 and 2). Each card (e.g., 110) preferably includes indicia of a play action event (e.g., "slam dunk"), the effect of playing the play action event (e.g., "automatic score"), and may include other instructions (e.g., "don't roll"). The number of each type of play action event in the preferred embodiment is shown in FIGS. 1 and 2 below the play action event, and is selected to approximate the occurrences in an actual sporting event (such as a basketball game). For example, four Slam Dunk Cards might be present among a total of sixty cards indicating that in real basketball about four plays out of every sixty result in a slam dunk. The basketball card game according to the present invention further includes multiple embodiments where the dice are replaced another type of random character generator. Also, the cards may be replaced by any mechanism for a player to strategically select one play action event for one turn of play from a plurality of play action events. Accordingly, use of the term "card" in the specification and claims includes Essentially, the basic method of playing the game according to the present invention involves the following steps:

a) designating a player in possession of a scoring opportunity;

b) all players receiving a hand of randomly selected play action events, where the hand is made up of a plurality of the play action events described above;

c) executing a turn of play comprising the player in possession strategically selecting one play action event from their hand for entry into play, triggering generation of a random character, and a change in possession occurring wherein the scoring opportunity transfers from the player in possession to a different player; and d) executing additional turns of play for at least one predetermined period.

Figure 4:
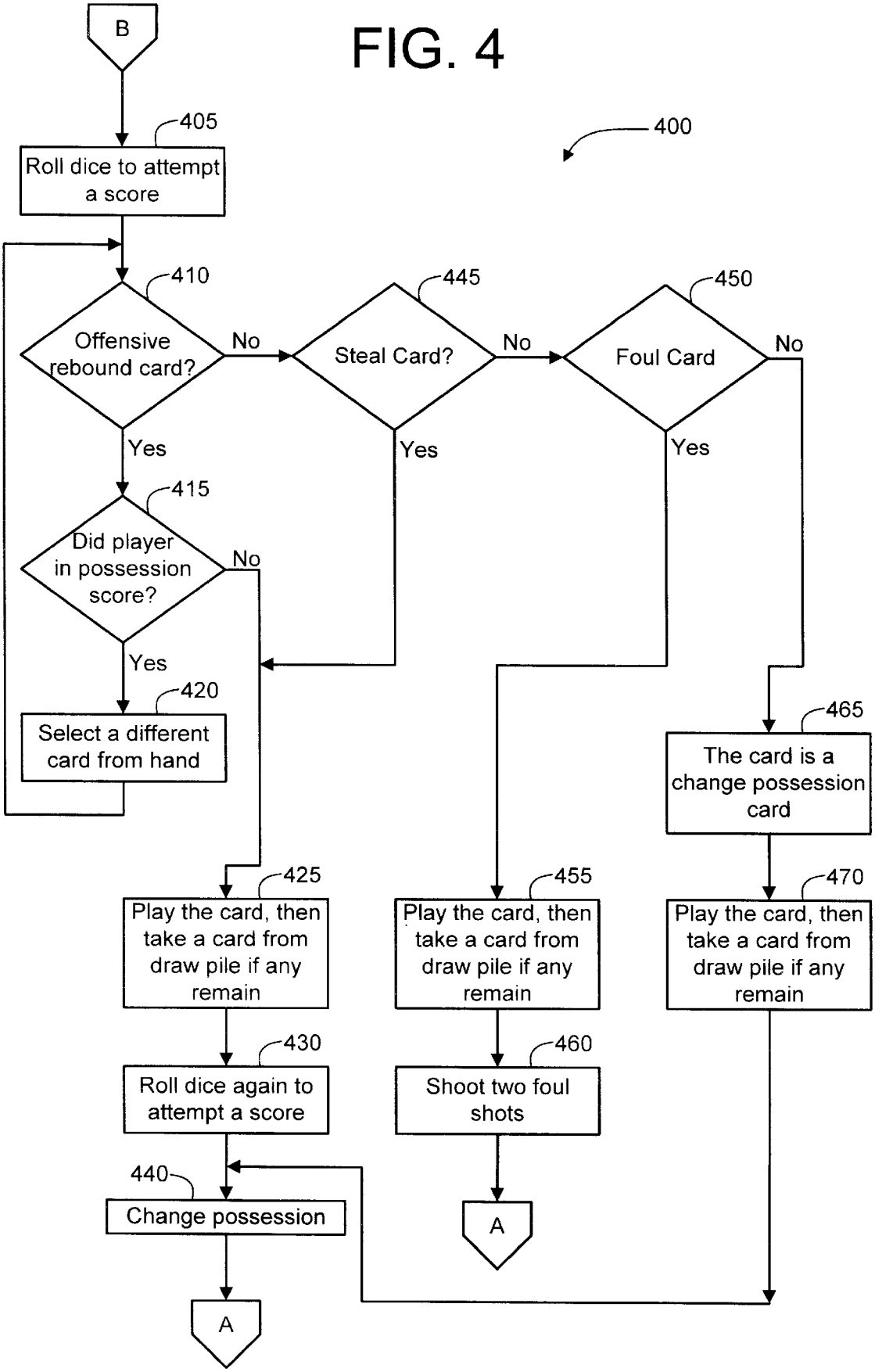
FIG. 4 is a flow chart of the remaining part of the method for executing the game.

Adding certain details to the method indicated results in the preferred embodiment of the method described in FIGS. 3 and 4. Notably, the basic method of playing the game is not limited to a basketball game since it is conducive to playing a soccer, hockey, tennis, volleyball, lacrosse, rugby, or water polo game as well as others. By simply making the play action events correspond to events from a different sport, the method can easily be adapted to a different sport and made to simulate the flow of events in a real game of the different sport.

In the preferred embodiment, the random number is generated or the dice are rolled at predetermined moments in executing the method of playing the game. FIG. 1 displays nine play action events on cards 100 entered before rolling the dice and FIG. 2 display four play action events on cards 200 entered after rolling the dice. Similarly, FIG. 3 displays the method of playing the game 300 when a card played before rolling the dice is selected and FIG. 4 displays the method of playing 400 when a card entered after rolling the dice is selected.

Playing a basketball game begins as shown in FIG. 3 with the step 305 of rolling the dice to determine the first player in possession. This is analogous to a tip-off in real basketball. A player having possession in the game is likewise analogous to a team in a real game having possession. The player in possession has a scoring opportunity and the ability to enter cards into play, just as a team having possession can attempt a score and try preplanned plays to improve the likelihood of scoring. In the next step 310, five cards are dealt from a shuffled deck to each player and the remaining cards are placed in a draw pile from which players will take replacement cards. Since real basketball is played with two teams matched against each other, the preferred embodiment allows for two players, however, the game is also conducive to including three or more players. If three or more players are involved, each player takes a turn in sequential order and then possession returns to the first player in possession to start another round of sequential turns. The remaining discussion of the preferred embodiment assumes two players are playing with the understanding the game can easily be expanded to include three or more players.

Regardless of the number of players, each player in possession must play one card and draw a replacement card before a change of possession occurs. Accordingly, step 315 requires the player in possession to strategically select one card from his hand to enter into play. Even though the cards indicate play action events rather than basketball plays, step 315 is roughly analogous to a real basketball team having a set of plays from which they can select one play to attempt. Depending on the circumstances, the selected play in real basketball may or may not be successful. Conversely, the cards 100 and 200 in the game indicate the result of selecting a play, that is, a play action event. While the result is predetermined on some cards, the players can still select when in the game they want a certain result, positive or negative, to occur. Thus, the next step in playing the game depends on the specific card selected by the player in possession.

According to step 320, if the selected card is a Slam Dunk 110, Clutch "3" 120, Double Dribble 130, Traveling 140, or 3 Seconds in the Key 150 card, then the card must be played before rolling the dice. In fact, selecting a card from step 320 will negate any need to roll the dice before changing possession to the other player as indicated by steps 325 and 330. The player in possession simply enters the card into play, takes a replacement card from the draw pile, then changes possession. Playing a Slam Dunk 110 card gives the player in possession an automatic score of two points and playing a Clutch "3" 120 card yields an automatic score of three points as a successful three-point field goal. Playing a Double Dribble 130, Traveling 140, or 3 Seconds in the Key 150 card means that the player in possession loses his turn and possession changes without a scoring opportunity. Obviously, the player in possession will not want to play the cards that yield the negative result of losing his turn, however, as explained below, all cards must be played. Part of the game strategy is selecting when to play the cards in a hand whether they yield a negative or a positive result. A player may want to play some cards early, save others until the end of the game, and keep still others in reserve to counteract cards that his opponent may play.

According to step 335, if the selected card is a Blocked Shot 160 or Loose Ball 170 card, then the card must be played before rolling the dice. Playing a Blocked Shot 160 card means that any score by the opponent in the preceding turn is negated and a loose ball occurs, indicating that possession is indeterminate. Similarly, playing a Loose Ball 170 card indicates that possession is indeterminate. After the step 340 of playing one of the step 335 cards and taking a replacement card, the players will both roll the dice as in step 345 with the player rolling the highest number becoming the player in possession. Accordingly, the step 330 indicating "change possession" means either that possession changes from one player to the other or that possession changes from being indeterminate after a loose ball to being vested in the highest rolling player. Step 330 is not intended to require a possession change from one player to the other since it is possible for a player in possession to regain possession after possession becomes indeterminate from a loose ball.

According to step 350, if the selected card is a Time Out 180 or a 3-Point Attempt 190 card, then the card must be played before rolling the dice. Playing a Time Out 180 card allows the player to slightly increase the likelihood of scoring. As indicated below, normally a score results from a roll of the dice yielding a total that is an odd number. Playing a Time Out 180 card is analogous to calling a time-out in real basketball where a special play can be devised to help score. Accordingly, a Time Out 180 card allows the player in possession to select two even numbers, in addition to the odd numbers, that will result in a score. Also, a 3 Point Attempt card allows the opponent to disqualify one odd number as a scoring total on the dice since a successful three-point attempt is less likely than a standard field goal attempt in real basketball. After the step 355 of playing one of the step 350 cards and taking a replacement card, the appropriate player will select numbers as in step 360 and the player in possession will roll the dice to attempt a score as in step 365. Finally, possession changes as in step 330.

Figure 5:
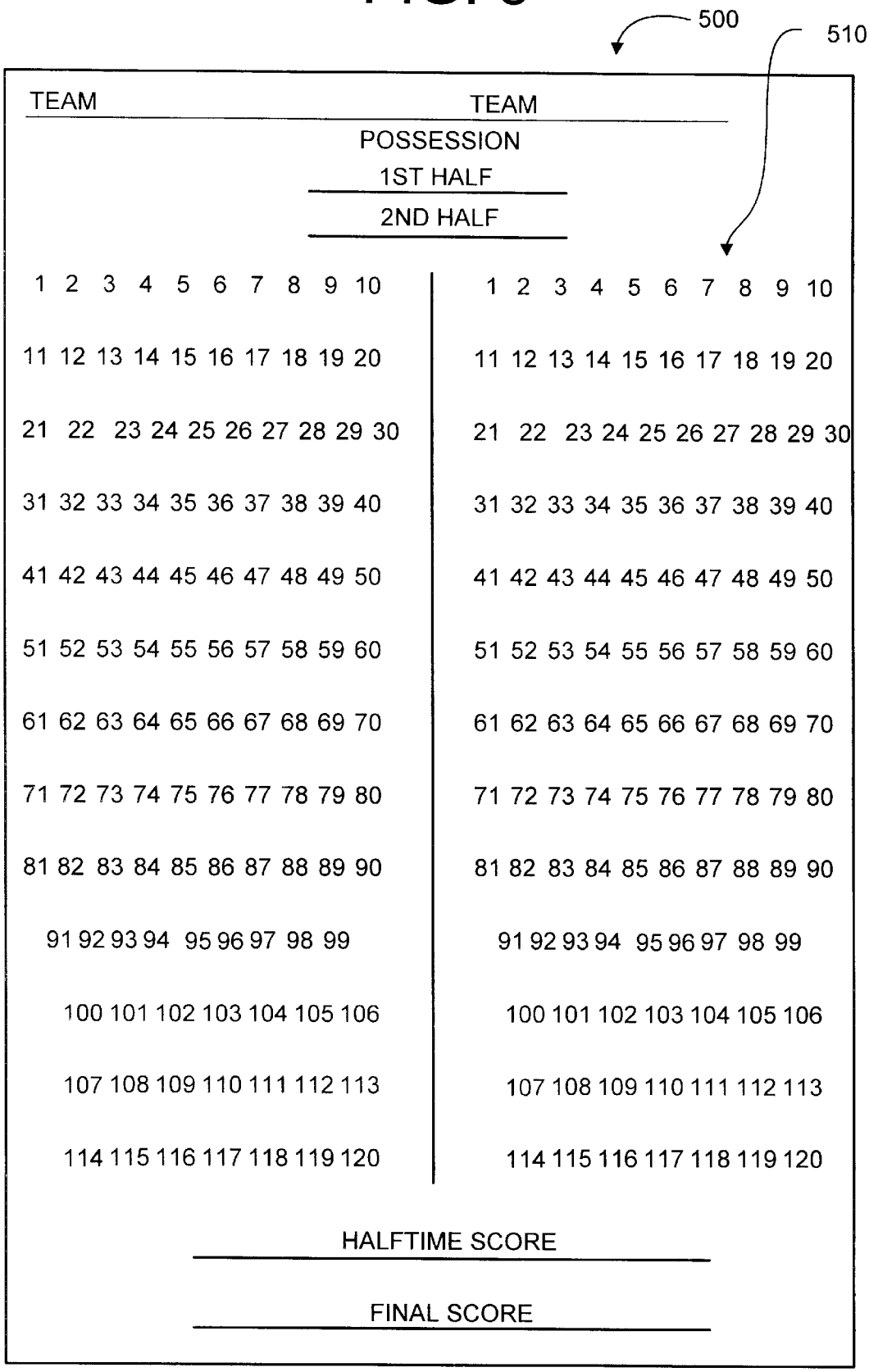
FIG. 5 is a display of a score card adapted for use with the cards or with the method of executing the game.

After change of possession as in step 330, players must account for any points earned or deducted as in step 370. Another element of the apparatus according to the present invention is a mechanism for keeping a running total of each player's score that, in the preferred embodiment, comprises the score card shown in FIG. 5. The score card 500 is adapted for use in a game played according to the basic method described above since it allows a simple, quick method of keeping a running total of each player's score. Since the score card includes a list 510 of a range of whole numbers that increase sequentially by one, the players need only circle the number that corresponds to their total score after a turn of play. The range of numbers begins with the lowest possible score of one point and extends to the highest typical score for the game.

After accounting for points as in step 370, players must determine whether the game half is over as in step 375. If the half is not over (i.e., step 375 equals "No"), then the new player in possession begins with the step 315 of selecting a card from his hand for entry into play. Understandably, a point will come in the game when no cards remain in the draw pile for players to replenish their hands. Players continue using the cards from their hand without taking a replacement card until one player plays his last card and then the other player may play one final card. Playing of the one final card marks the end a half. The end of a half in the game 380 is analogous to the end of a half in real basketball, in that the first player in possession at the start of the first half must give up possession to his opponent at the start of the second half. Accordingly, possession is already established at the start of the second half and the step 305 of rolling dice to determine possession is not necessary. Otherwise, the second half is started the same as the first half was started; the cards are reshuffled, dealt again, and a new draw pile established.

The above description relates to the method of playing the game 300 when the selected card must be entered before rolling the dice. The method of playing the game 400 when the selected card must be entered after rolling the dice is displayed in FIG. 4. If the card selected in step 315 is not one of the cards indicated in steps 320, 335, or 350, then the player in possession must roll the dice as indicated in step 405 in an attempt to score. A player scores a standard field goal worth two points by rolling a total which is an odd number. If the player happens to roll doubles, where the result on each die matches the other, a three-point score will be awarded even though the total is an even number.

According to steps 410, 415, and 420, if the card selected is an Offensive Rebound card, then the player in possession may only play the card if he did not score from rolling the dice. The no-score requirement is analogous to real basketball since an athlete can only get a rebound from a shot taken if the shot is missed. Assuming the player in possession did not score from rolling the dice, he plays the offensive rebound card, takes a replacement card, and rolls the dice again in a second attempt to score as indicated in steps 425 and 430. The change in possession then occurs as in step 440 and play proceeds with the step 370 of accounting for points indicated in FIG. 3.

According to step 445, if the card selected is a Steal card, then the player in possession will get another chance to score. The player in possession enters the Steal card and takes a replacement card as indicated in step 425 and then rolls the dice again as in step 430 before changing possession as in step 440.

According to step 450, if the card selected is a Foul card, then the player in possession will have to give his opponent an opportunity to score, but will regain possession. The player in possession enters the Foul card and takes a replacement card as indicated in step 455. Playing a Foul card means the player in possession has fouled his opponent, requiring the step 460 of his opponent temporarily gaining possession and executing two foul shots. In real basketball, this would be analogous to the team formerly in possession fouling their opponent after the opponent gains possession of the ball. The team fouled will attempt a foul shot, but the fouling team will have a significant chance of regaining possession through a rebound. Foul shots are a high percentage shot in real basketball, accordingly, the opponent rolls the dice two times, once for each foul shot, with an improved likelihood of scoring one point each time. Except for two numbers that the player in possession will disqualify, any result on the dice will score one point. Notably, the foul shooting opponent is not allowed to play a card from his hand during his temporary possession. After executing the two foul shots, the player in possession regains possession and play continues with the step 370 of accounting for points.

Also according to step 450, if the card selected is not a Foul card, then the only card remaining is a Change Possession card as indicated in step 465. The Change Possession card is the one in greatest abundance and allows a player to satisfy the rule of playing one card in each turn of play without entering one of the other 12 cards, all of which have either a positive or negative effect on the player in possession. Essentially, the Change Possession card can be considered neutral as to any effect on the players. In real basketball, a change of possession occurs whenever a team makes a field goal or their opponent gets a defensive rebound, thus, playing a Change Possession card can also be considered analogous to real basketball. After entering the card, the player in possession takes a replacement card as in step 470, possession changes to the other player as in step 440, and play continues with the step 370 of accounting for points.

Though not shown in the accompanying figures, another feature of the preferred method of playing the game increases its resemblance to real basketball. In real basketball, technical fouls are assessed for violating certain rules. One rule of play in the preferred method is that cards are played at their appropriate time, either before or after the step 405 of rolling the dice to attempt a score. Accordingly, violation of the timing for entering cards will result in a technical foul if called by the opponent. The opponent will receive temporary possession to execute one free throw wherein only one number is disqualified by the player that committed the technical foul. This is analogous to the best player in real basketball being permitted to make the free throw attempt following a technical foul. Players may be additionally encouraged to abide by the timing rules if two free throws are allowed for the second and subsequent technical fouls. Also, if a game ends with a tie, then overtime can be provided by dealing each player a few cards from a shuffled deck and placing a smaller number of cards in the draw pile than normal. This is analogous to providing a five-minute overtime period in a real basketball game.

While the preferred embodiment is described as a card game that uses a pair of dice to determine the outcome of certain play action events, various modifications are possible within the scope of the present invention. For example, rather than using a pair of dice to generate a random number or character, an electronic device may be used instead. One suitable electronic device may simply simulate the rolling of dice. Another suitable electronic device may include different buttons for each appropriate play action event. In this manner, a "score" or "no score" indication may be made by pushing the appropriate play action button. Each button could provide odds that are the same as rolling dice, as described with respect to the preferred embodiment. In the alternative, any odds for a play action event may be programmed in to the electronic device. This option would allow an electronic device to more closely simulate a real game by providing the desired odds for each appropriate play action event. The applicable odds may be hard-programmed into such a device, or may be customizable by the user.

Another variation that is within the scope of the present invention is a game implemented as a video game or as a computer game. The flow of the game would be similar to the flow of FIGS. 3 and 4, but would take place on a computer screen with the odds of the play action events being provided electronically. This game, which is preferably played so that opponents cannot see each other's hands, would be especially suited to play between players on a computer network such as the Internet.

While the invention has been particularly shown and described with reference to preferred embodiments thereof, it will be understood by those skilled in the art that various changes in form and details may be made therein without departing from the spirit and scope of the invention. Accordingly, unless otherwise specified, any dimensions of the apparatus indicated in the drawings or herein are given as an example of possible dimensions and not as a limitation. Similarly, unless otherwise specified, any sequence of steps of the method indicated in the drawings or herein are given as an example of a possible sequence and not as a limitation.

I claim:

1. A method of playing a game comprising:

a) designating a player in possession of a scoring opportunity and a second player;

b) each player receiving a hand of randomly selected cards, each card describing a basketball play action event independently selected from the group consisting of slam dunk, three-point field goal, double dribble, traveling, three seconds in the key, blocked shot, loose ball, time out, three-point field goal attempt, offensive rebound, steal, foul, and change possession;

c) executing a turn of play having an end, wherein the end of the turn of play is denoted by changing possession of the scoring opportunity from the player in possession to the second player and by changing possession of the scoring opportunity from being indeterminate to being determined and wherein the turn of play comprises i) the player in possession strategically selecting one card from their hand for entry into play;

ii) if the play action event described on the selected card is one of: slam dunk, three-point field goal, double dribble, traveling, and three seconds in the key, then entering into play the selected card, the player in possession receiving a randomly selected replacement card, and changing possession;

iii) if the play action event described on the one card is one of: blocked shot, loose ball, time out, and three-point field goal attempt, then entering into play the one card, the player in possession receiving a randomly selected replacement card, determining a result of the play action event described on the one card by tossing at least one die, and changing possession;

iv) tossing at least one die to determine whether a score results from the scoring opportunity;

v) if the play action event described on the selected card is offensive rebound and no score resulted from tossing at least one die, then entering into play the selected card, the player in possession receiving a randomly selected replacement card, tossing at least one die again in an attempt to score, and changing possession;

vi) if the play action event described on the selected card is steal, then entering into play the one card, the player in possession receiving a randomly selected replacement card, tossing at least one die again in an attempt to score, and changing possession;

vii) if the play action event described on the selected card is one of: foul and change possession, then entering into play the selected card, the player in possession receiving a randomly selected replacement card, and changing possession;

viii) imposing a technical foul if tossing at least one die occurs before entering into play the selected card and the play action event described on the selected card is one of: slam dunk, three-point field goal, double dribble, traveling, three seconds in the key, blocked shot, loose ball, time out, and three-point field goal attempt; and ix) imposing a technical foul if entering into play the selected card occurs before tossing at least one die and the play action event described on the one card is one of: offensive rebound, steal, foul, or change possession; and d) executing additional turns of play for at least one period, wherein the cards are limited in number and the period is ended by the player in possession entering their last card into play and the second player subsequently being the player in possession for one turn of play.

* * * * *